United States Patent [19]

Hiraga et al.

[11] Patent Number: 4,862,434

[45] Date of Patent: Aug. 29, 1989

[54] TIMEPIECE STRUCTURE

[75] Inventors: Imao Hiraga; Satoshi Yamazaki; Takehide Yamada; Tadashi Nishitani, all of Suwa, Japan

[73] Assignee: Shiojiro Kogyo Kabushiki Kaisha, Nagano, Japan

[21] Appl. No.: 138,904

[22] PCT Filed: Jan. 12, 1987

[86] PCT No.: PCT/JP87/00015

§ 371 Date: Dec. 28, 1987

§ 102(e) Date: Dec. 28, 1987

[87] PCT Pub. No.: WO87/06031

PCT Pub. Date: Oct. 8, 1987

[30] Foreign Application Priority Data

| | | | |
|---|---|---|---|
| Apr. 1, 1986 | [JP] | Japan | 61-48711[U] |
| Apr. 1, 1986 | [JP] | Japan | 61-48712[U] |
| Apr. 30, 1986 | [JP] | Japan | 61-100165 |
| Jun. 11, 1986 | [JP] | Japan | 61-88688[U] |
| Jun. 24, 1986 | [JP] | Japan | 61-96078[U] |

[51] Int. Cl.[4] ..... G04B 19/24; G04B 19/02

[52] U.S. Cl. ..... 368/190; 368/220

[58] Field of Search ..... 368/76, 80, 185–190, 368/220, 319–321

[56] References Cited

U.S. PATENT DOCUMENTS

| | | | |
|---|---|---|---|
| 4,295,215 | 10/1981 | Kiyai et al. | 368/190 |
| 4,351,040 | 9/1982 | Aoki | 368/220 |
| 4,408,896 | 10/1983 | Ikegami | 368/319 |
| 4,496,246 | 1/1985 | Ota et al. | 368/220 |

FOREIGN PATENT DOCUMENTS

| | | |
|---|---|---|
| 58-49281 | 4/1983 | Japan . |
| 6329270 | 4/1983 | Japan . |

*Primary Examiner*—Vit W. Miska

*Attorney, Agent, or Firm*—Blum Kaplan

[57] ABSTRACT

An electronic timepiece in which a gear train is driven and the hand is moved by a stepping motor and, more particularly, the timepiece which surely permits time correcting owing to the simple structure even if the gear train is formed of plastic materials. One end of the third wheel and pinion engaged with the center wheel is guided or held by the operating lever interlocked with the external control member. When the external operating member is moved into the axis direction, this operating lever is rotated and the third wheel and pinion is radially removed from the engagement of the center wheel and pinion.

9 Claims, 9 Drawing Sheets

TIMEPIECE STRUCTURE

INDUSTRIAL FIELD FOR APPLICATION:

This invention relates to a time piece structure for time correcting and, in particular, to the structure of timepiece in which a gear train is formed of plastic materials.

BACKGROUND OF ART:

In conventional timepieces, a gear train is formed of a center wheel having an elastic portion which is held and supported by a center wheel arbor.

When time is corrected, the center wheel is sheared and run idle through the center wheel arbor, thereby preventing trasnmission of rotation of the gear train from being transmitted to second hand (fourth wheel and pinion). Further, in a setting mechanism, a clutch wheel is moved by a winding stem, a setting lever, a yoke, and so on. The clutch wheel is fit into the members of gear train, and then time correcting is carried out by external operating materials.

However, a conventional timepiece structure has the following problems since a sharing machanism utilizes the elastic portion of the center wheel in order to correct time.

1: The center wheel shearing torque is unstable. When shearing torque is so high, wheel members moving for time correcting, such as a center wheel pinion, a minute wheel, and a clutch wheel tend to be worn and broken.

Further, since the initial state of second wheel shearing torque is relatively high, the above members moving for time correcting must be formed of high hardened metallic materials (hardeded carbon steel), thereby causing high cost from the viewpoints of process and materials. Plastic materials and the molding technique have been recently improved and a gear train structure made of all plastic materials has been investigating. However, it was impossible to realize the gear train made of all plastic members as far as a gear train made of a shearing mechanism is adopted.

2: When the center wheel shearing torque is so low, a minute hand is individually rotated by fine vibration, light impact or the like in normal operating condition, namely the normally operating condition in which the winding stem is pushed into the inside of the timepiece (hereinafter referred to as the normal operating condition). As a result, time tends to be wrong.

3: In a setting mechanism, a clutch wheel must be made of metallic materials in order to ensure the intensity.

When time is corrected, a clutching wheel must be engaged with a winding stem as an external control member at the angle cutting portions thereof to transmit the rotation. In the normal operation condition, a clutch wheel must be removed from the engagement with gear train members.

Therefore, metallic materials such as a setting lever and a yoke are required in a conventional timepiece in order to move a clutch wheel.

This invention solves such problems and an object of the invention is to obtain smooth time correcting mechanism without a shearing mechanism formed of wheels by removing one part of gear train members when time is corrected.

Another object of the invention is to provide a timepiece improved in rationality by utilizing a plastic material for not only a gear train mechanism but also a setting mechanism instead of conventional requirement such as a setting lever, a yoke or the like.

SUMMARY OF THE INVENTION:

In the timepiece structure according to this invention, one part of gear train members is held and guided by the operating lever which is sequentially operated with the external control member. When time is corrected, one part of gear train members is removed from engagement with a control lever. Further, the clutch wheel is always engaged with the member of the gear train according to the setting structure of the clutch wheel made of plastic and external control member in which concave and convex portions are provided at the engaging portion of the clutch wheel. In the normal position, the clutch wheel is driven or rotated by the members of gear train. When time is corrected, by pulling out the external control members, the clutch wheel is frictionally engaged with the convex portion and is operated with the external control members to be rotatable.

BEST MODE FOR CARRYING OUT THE INVENTION:

This invention is described below in reference with the accompanying drawings.

Figure 1:
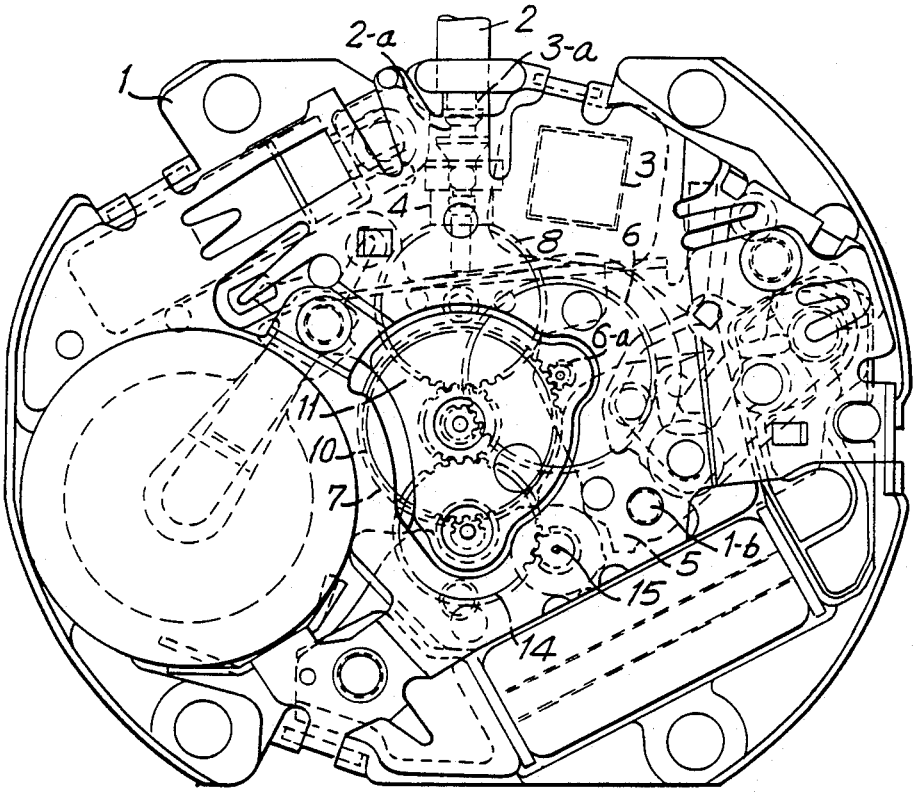
FIG. 1 is a plan view of an example of a timepiece structure according to the present invention.

FIG. 1 is a plan view of one example of the present invention and shows the normal position.

Figure 2:
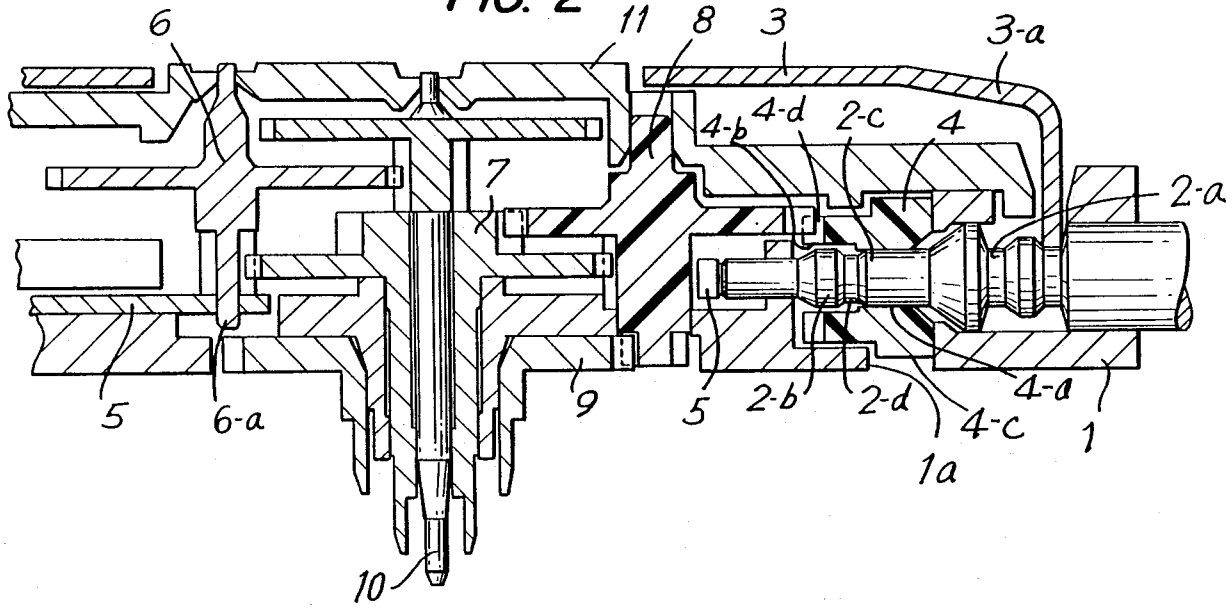
FIGS. 2 and 3 are sectional views of a part of timepiece of FIG. 1.

FIG. 2 is a sectional view of one part of FIG. 1.

Figure 3:
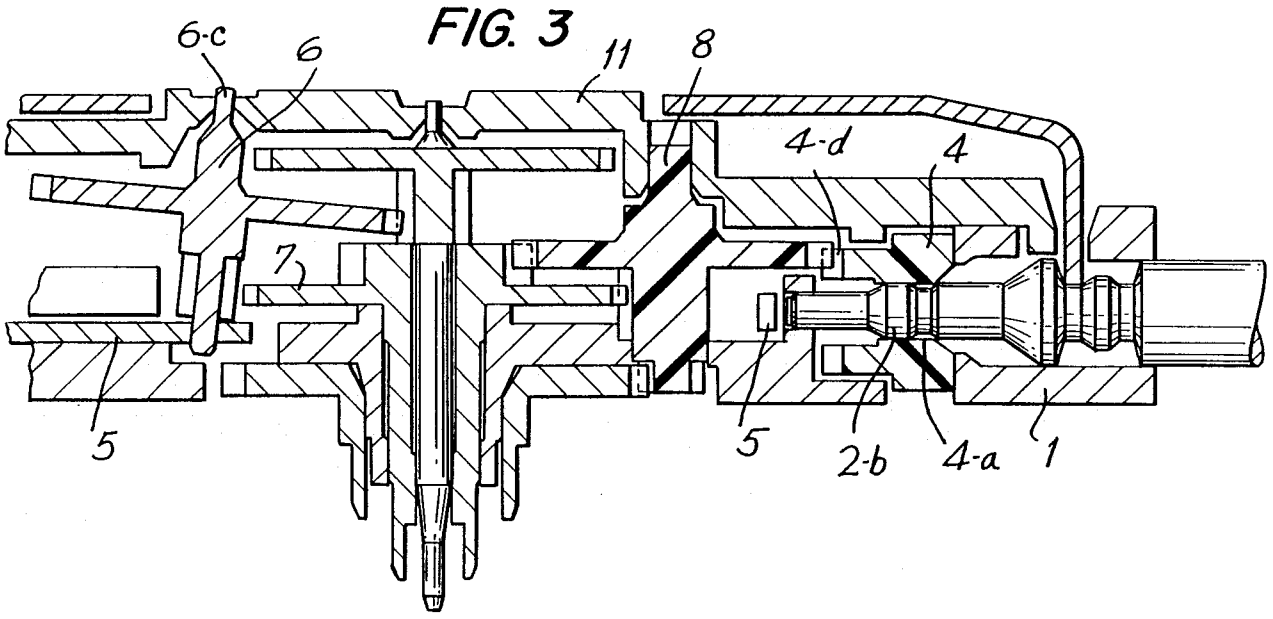

FIG. 3 is a sectional view of one part of the condition for correcting time.

Main plate 1 is a frame for a timepiece movement. Winding stem 2 is an external control member. Winding stem 2 has click portion 2-*a* which is engaged with elastic portion 3-*a* of plus terminal 3 of power source for positioning the winding stem. Further, frictional engagement convex portion 2-*b* is provided on the end portion of winding stem 2 which the clutch wheel 4 is put on, which is described later for description of time correcting. The winding stem is guided by main plate 1.

Clutch wheel 4 is made of plastic materials and has a little steps between a center hole 4-*a* and wheel bottom 4-*b*. Minute wheel 8 is formed of plastic materials and has a wheel and a pinion.

Here, the guide structure of the clutch wheel and the minute wheel is described in detail. In the axial direction of the clutch wheel, clutch wheel rim 4-*c* is loosely engaged with and guided by concave portion 1-*a* of main plate 1, thereby guiding the clutch wheel to the given position. In the radial direction of the clutch wheel, central portion thereof 4-*a* and bottom portion thereof 4-*b* engaged with the minute wheel mentioned below are loosely engaged with and guided by winding stem axis 2-*c* and the convex portion 2-*b* of winding stem, respectively.

In the radial direction of the minute wheel, the trunk of minute wheel is guided by a hole of main plate. In the axial direction of the minute wheel, the lower surface of minute wheel is guided by the projection of main plate and the clearance is determined by a gear train bridge mentioned below.

As is clear from FIG. 2, since the clutch wheel and the minute wheel are guided by the main plate constituted in one body, there are little variation of the amount of engagement in radial direction of minute wheel. Therefore, the stable engagement state is obtained.

Moreover, the convex portion or projection of winding stem is closely fixed with interference in the center hole 4-*a* of the clutch wheel. When the winding stem is fixed in the center hole 4-*a* of the clutch wheel, when the winding stem is controlled after fixing thereof, and even if the clutch wheel is loaded by the convex portion of the winding stem, the rim 4-*c* of the clutch wheel is contacted with the concave portion 1-*a* of main plate to guide the clutch wheel in the given position and to provide the destruction of the wheel of the clutch wheel.

When time is corrected, the winding stem is pulled out, the winding stem convex portion 2-*b* is frictionally engaged with clutch wheel central hole 4-*a* to transmit the rotary force of winding stem.

The reference numeral 5 stands for an operating lever. A gear train guide/hold portion supporting the lower pivot 6-*a* of the third wheel and pinion 6 are provided on operating lever 5, and the lever is rotated by the amount according to the movement of winding stem around axis 1-*b*, which is provided on main plate. A minute hand is mounted on the end portion of center wheel and pinion 7. The minute wheel is ordinally engaged with the center pinion and the gear portion 4-*d* of clutch wheel. An hour hand is mounted on the end portion of hour wheel 9. A second hand is mounted on the end portion of the forth wheel and pinion 10. The gear train portion comprises the fifth wheel and pinion, rotor besides the above members. Grear train bridge 11 guides the fifth wheel and pinion, the fourth wheel and pinion, the third wheel 6 and pinion and the upper pivot of minute wheel 8. The rotor is rotated by electric signal and the number of rotation is reduced by gear train. Each wheel operates as usual for analogically displaying seconds, minutes, and hours, and simultaneously, the clutch wheel is engaged with the minute wheel to rotate the winding stem.

Thereafter, condition of time correcting is explained. When the winding stem is pulled out, the operating lever is rotated around the guide axis, the holding portion for guiding the third lower pivot is moved, the third wheel and pinion results in tilting under support of the third upper pivot by the gear train bridge, and then the third pinion are removed from the engagement of the center wheel and pinion.

At the same time as the above movement, the center hole of the clutch wheel is closely engaged in the convex portion of the winding stem. The rotation of the winding stem is transmitted from the clutch wheel to the minute wheel, from the minute wheel to the center wheel and pinion, and from the minute wheel to the hour wheel. Thus time can be corrected as the second hand is fixed.

Figure 4:
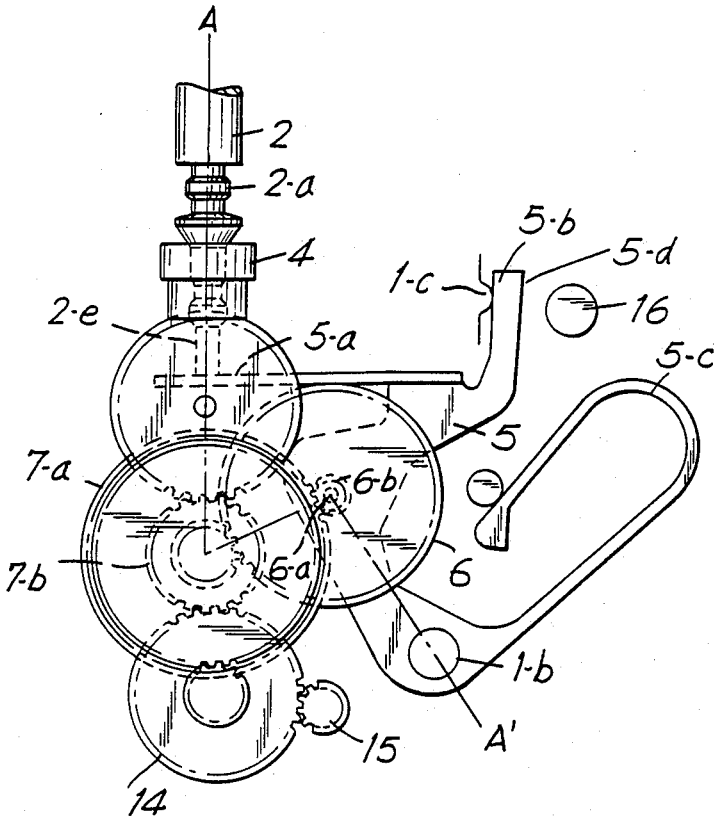
FIG. 4 is a plan view of a part of timepiece of FIG. 1.
Figure 5:
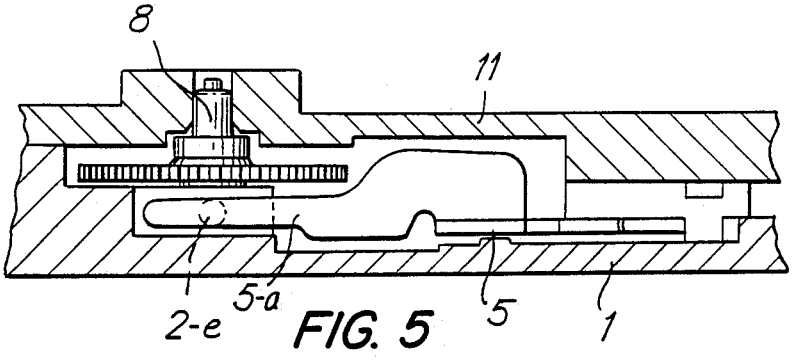
FIG. 5 is a lateral view of FIG. 4.

FIGS. 4 and 5 show the detailed structure of the operating lever 5. FIG. 4 is a plan view and FIG. 5 is a sectional view showing the portion of the winding stem which the operating lever is contacted with.

The winding stem 2 is the external operating member. In the normal operation condition, the winding stem is loosely engaged with the clutch wheel 4. For time correcting, the winding stem is pulled out and is frictionally engaged with the clutch wheel, thereby transmitting the rotaion of the winding stem. The winding stem has concave and convex portion 2-*a* functioning as a click, which is engaged with elastic portion 3-*a* of battery plus terminal 3, thereby determining the position of winding stem 2.

Operating lever 5 has the gear train guide/hold portion for lower pivot 6-*a* of the third wheel and pinion 6. Operating lever 5 is rotated and guided around axis 1-*b* on the main plate.

In the normal condition, the operating lever has elastic portion 5-*a* which the end portion 2-*e* of the winding stem is directly contacted. Point portion 5-*b* is directly contacted with the main plate, thereby positioning. Center wheel 7-*a* is engaged with the third pinion 6-*b*.

Center wheel and pinion 7 comprise the above wheel and pinion 7-*b*, and the minute hand is mounted on the end portion thereof. Minute wheel 8 is always engaged with center pinion and the clutch wheel 4. Hour wheel 9 is engaged with the minute pinion and the hour hand is mounted on the end portion thereof (see FIG. 2). The gear train portion comprises the fifth wheel and pinion 14, rotor 15 besides the above members. The gear train bridge 11 guides the rotor, the fifth wheel and pinion, the fourth wheel and pinion, the third wheel and pinion, and the upper pivot of the minute wheel. The lower pivot of each wheel and pinion except for the third wheel and pinion are guided by main plate 1. The rotor is rotated by electric signals, the number of rotation is reduced by gear train, and each wheel and pinion analogically displays seconds, minutes, and hours, thereby functioning as a conventional timepiece.

Thereafter, the condition of time correcting is explained. When the winding stem is pulled out, the operating lever is released from the position control by the end portion of the winding stem. The operating lever is clockwise rotated by U-shaped elastic portion 5-*c* around main plate axis 1-*b*, thereby the end portion 5-*d* being contacted with the reset pin on the main plate.

The third wheel and pinion are tilted under the guide of the upper pivot 6-*c* by gear train bridge and the third pinion is removed from the engagement of the center wheel and pinion. It is because that the lower pivot thereof is guided and holded by the operating lever and that the operating lever is moved mentioned as above. Accompanied with the above motion, the clutch wheel is closely engaged with the convex portion 2-*b* of the winding stem. The rotation of the winding stem is transmitted from the minute wheel to center wheel and pinion and from the minute pinion to the hour wheel. Thus time correction for hour or minute can be completed with fixed seconds hand.

This invention provides the new structure, in which the operating lever for guiding or holding the third wheel and pinion are improved in the stability of positioning.

In the normal operation condition, the amount of engagement between the center wheel and the third wheel is about 0.1 to 0.15 mm, and the operating lever must be always guided in the fixed position in order to obtain the stable efficiency of gear train. The operating lever is engaged with the end portion of the winding stem, and the edge 5-*b* of operating lever is directly contacted with main plate 1-*c*, thereby positioning.

The operating lever directly contacted with the end portion of the winding stem has the elastic portion for absorbing the shift of the end portion of the winding stem. This elastical force is larger than that of U-shaped elastic portion 5-*c*.

As is clear from the drawing, the operating lever according to this invention determines the position for engagement of the center wheel and pinion and the third wheel and pinion, using only the rigid portion thereof. The operation has the elastic material at the moving portion of operating lever.

Figure 6:
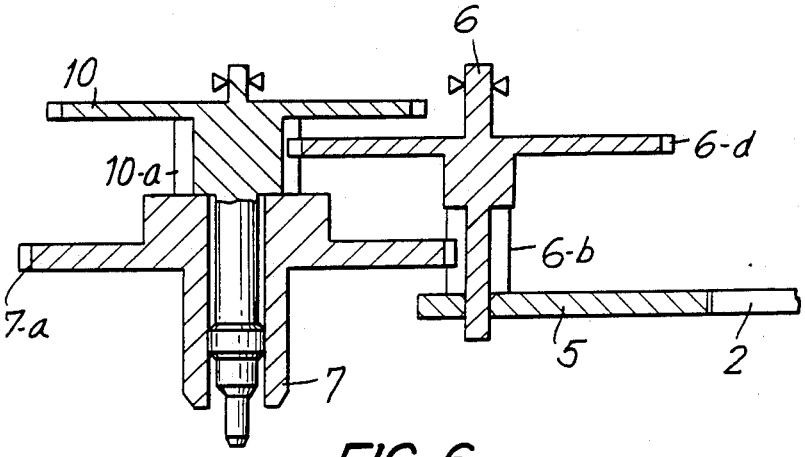
FIGS. 6 and 7 are schematic sectional views of a principal portion of timepiece of FIG. 1.
Figure 7:
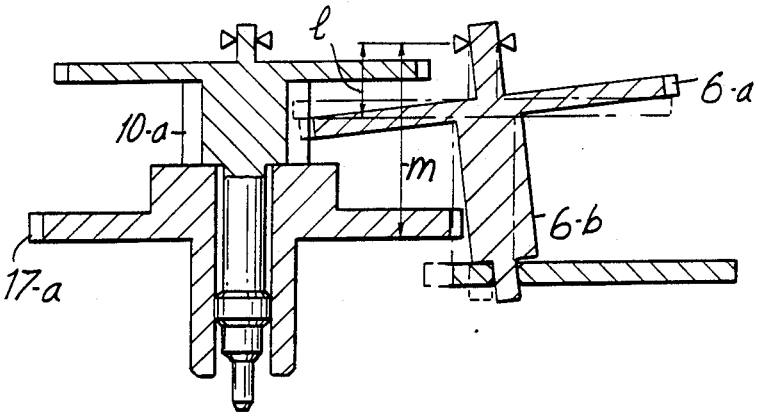

Thereafter, the engagement relation between the third wheel and pinion 6 and the center wheel and pinion 7 are described in detail in reference with FIGS. 6 and 7.

FIG. 6 schimatically shows third wheel and pinion 6, center wheel and pinion 10, operating lever 5 and the winding stem 2 shown in FIGS. 2 and 3.

FIG. 6 is a sectional view of the wheels and pinions shown in FIG. 1. Third wheel and pinion 6 comprise wheel 6*a* and pinion 6*b* engaged with pinion 10 *a* of fourth wheel 10 and wheel 7*a* of center wheel, respectively. The reduction rate from the fourth wheel to the center wheel is 1/60 as well known.

FIG. 7 is a sectional view of the third wheel and pinion and shows the condition for hand correcting by controlling external control member. Here, it is important to remove the only pinion 6*b* from the third wheel and pinion. This structure is required to prevent the hands from shifting by the interference between the sumits of the wheels when the third wheel and pinion are engaged after hand correcting. If pinion 6*b* of the third wheel and pinion are removed from wheel 7*a* of the center wheel and pinion, the hand shift of the fourth wheel and pinion never occurs. Further, the hand shift caused by the difference of circular pitchs between the third pinion and the center wheel can be reduced to a fine range because the amount of hand shift is larger in the external circumference of the center wheel. This fact is clearly understood compared with the hand shift in the case that third wheel and pinion 6*d* are removed from forth pinion 10 *a*. In order to complete this structure, the position of the third wheel and the third pinion m/e should be as large as possible, at least twice.

Figure 8:
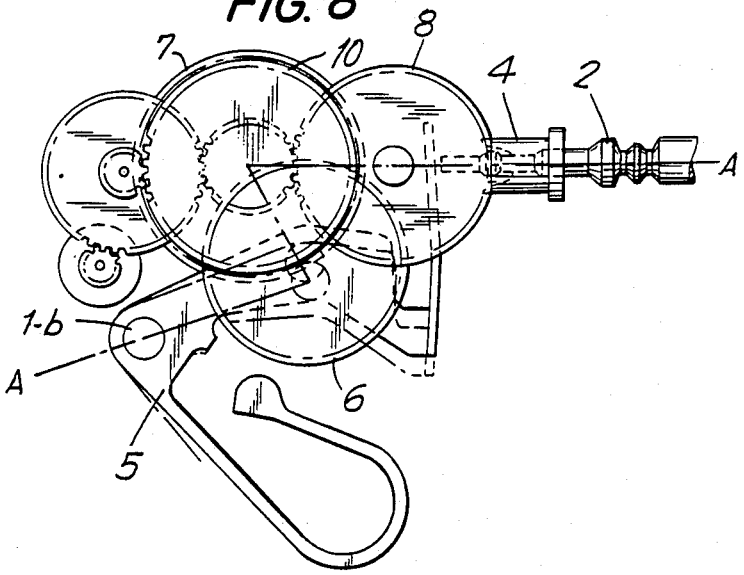
FIG. 8 is a schematic plan view of one part of timepiece of FIG. 1.
Figure 9:
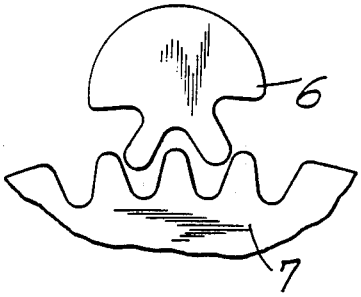
FIG. 9 is a plan view of one part of timepiece of FIG. 8.

Thereafter, the configuration of the above operating lever 5 is described in reference with FIGS. 8 and 9. The configuration of operating lever 5 is schematically illustrated in reference with FIG. 4.

FIG. 9 is a plan view showing the engagement condition of the wheel of center wheel and pinion 7 and the pinion of the third wheel and pinion. The engagement amount of the wheel and pinion for timepiece is about 0.2 mm in the wheel pitch, the wheel thickness is 0.09 mm, and the backlash is about 0.04 mm. Unless the dimention is maintain in this invention, the backlash of each wheel and pinion or the multiplation of erros in the configuration of gears causes the increase of the direction errors of hours hand, minute hands, and seconds hands, thereby the hands wrongly indicating the graduation of dial. Such a product is defective.

When under the above dimension, the wheels and pinions are removed from the engagement, there is not so much problems in dimension. The movement of the third lower pivot due to the control of the winding stem is relatively rough. Should the position of minutes hand is wrong due to the rotation of the center wheel, thereafter time correction for hours and minutes is operated, namely, the operation for rotating the wheels from the center wheel and pinion to the clutch wheel.

However, after completion of time correcting, when the winding stem is put back into the carrying condition so that wheels are engaged together, it is necessary to engage the third wheel and pinion with the center wheel and pinion without rotary force in order to engage the end portion of the third pinion with the center wheel at a speed of 10 msec. In this case, it is necessary to engage the wheels by the movement along the center line from center wheel and pinion shaft to the third wheel and pinion shaft as shown in FIG. 8.

Figure 11:
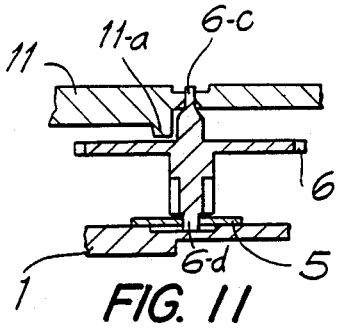
FIG. 11 is a sectional view of one part of timepiece of FIG. 10.

It is necessary that the rotary center 1-*b* of the operating lever is disposed into the orthogonal direction with respect to the center line of the center wheel and pinion 7, the third wheel and pinion 6. Further, for the clearance of the upper pivot side, Example 1 is explained in referece with FIGS. 10 and 11. FIG. 11 is a sectional view of FIG. 10 taken along A–B′.

Figure 10:
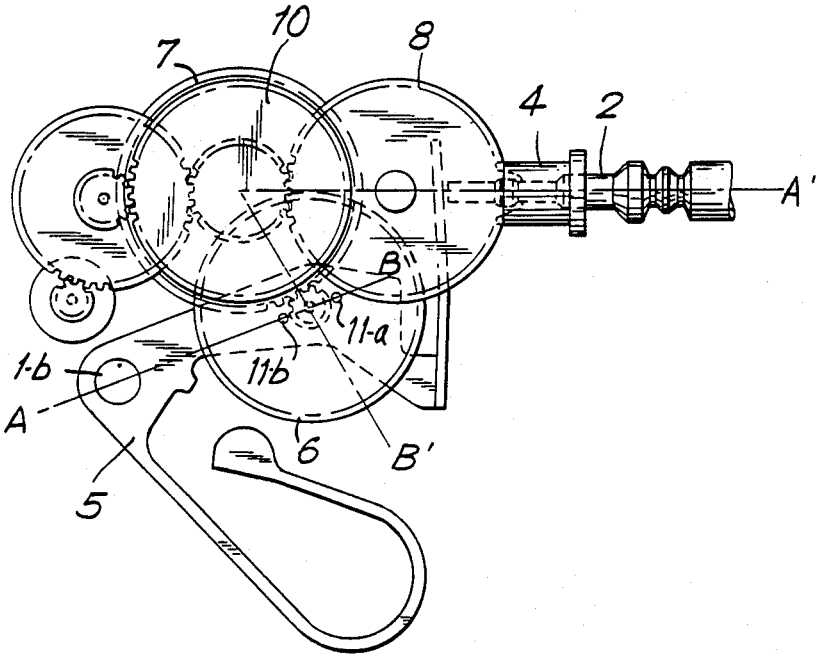
FIG. 10 is a plan view of one part of timepiece of FIG. 1.

The example provides the clearance structure of the upper pivot of third wheel and pinion 6, wherein the upper pivot is supported by a gear train bridge as a guide and the lower pivot is moved and tilted by an operating lever. As shown in a sectional view, when time is corrected, the third wheel and pinion are tilted using the upper pivot 6-*c*, so that the wheel and pinion are removed from engagement. Therefore, if the clearance determining members are provided on a gear train having 0.005 to 0.1 mm necessary for wheel rotary movement, when the third wheel and pinion are tilted and moved, the clearance determining member and the upper portion of the wheel are touched together, thereby deforming the wheel or the upper pivot. As a result, the movement is defective. Therefore, the clearance determining members should be provided one part of the circumference of the upper pivot, and not the all thereof. As shown in FIGS. 10 and 11, the clearance determining members 11-*a* and 11-*b* for the gear train bridge should be provided along the center line, on which there are the least variation in the tilt of the third wheel and pinions, between the pivot center 6-*c*, and the rotary center 1-*b* of the operating lever.

Figure 12:
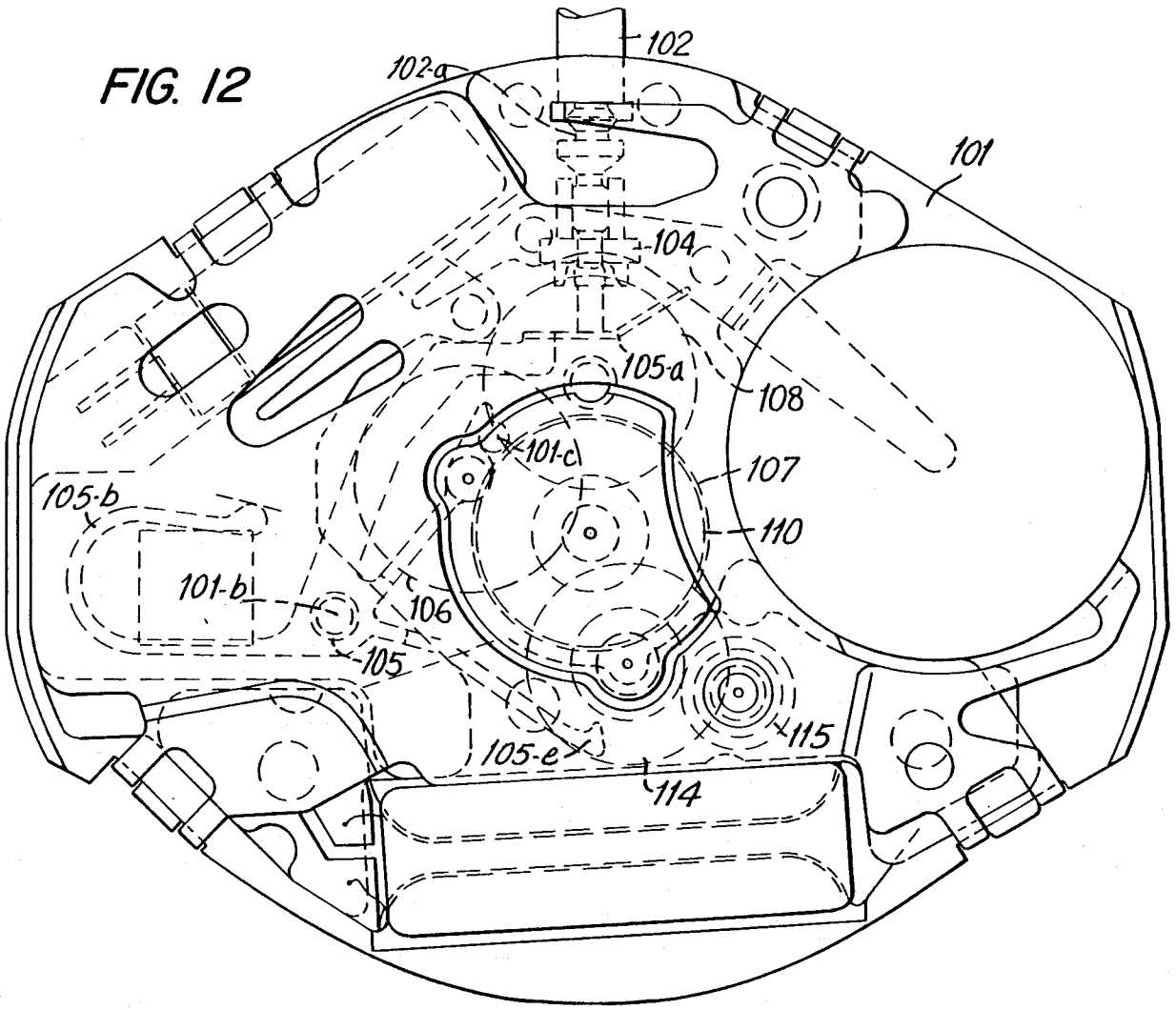
FIGS. 12 and 13 are plan views of the second exmaple of the present invention.
Figure 13:
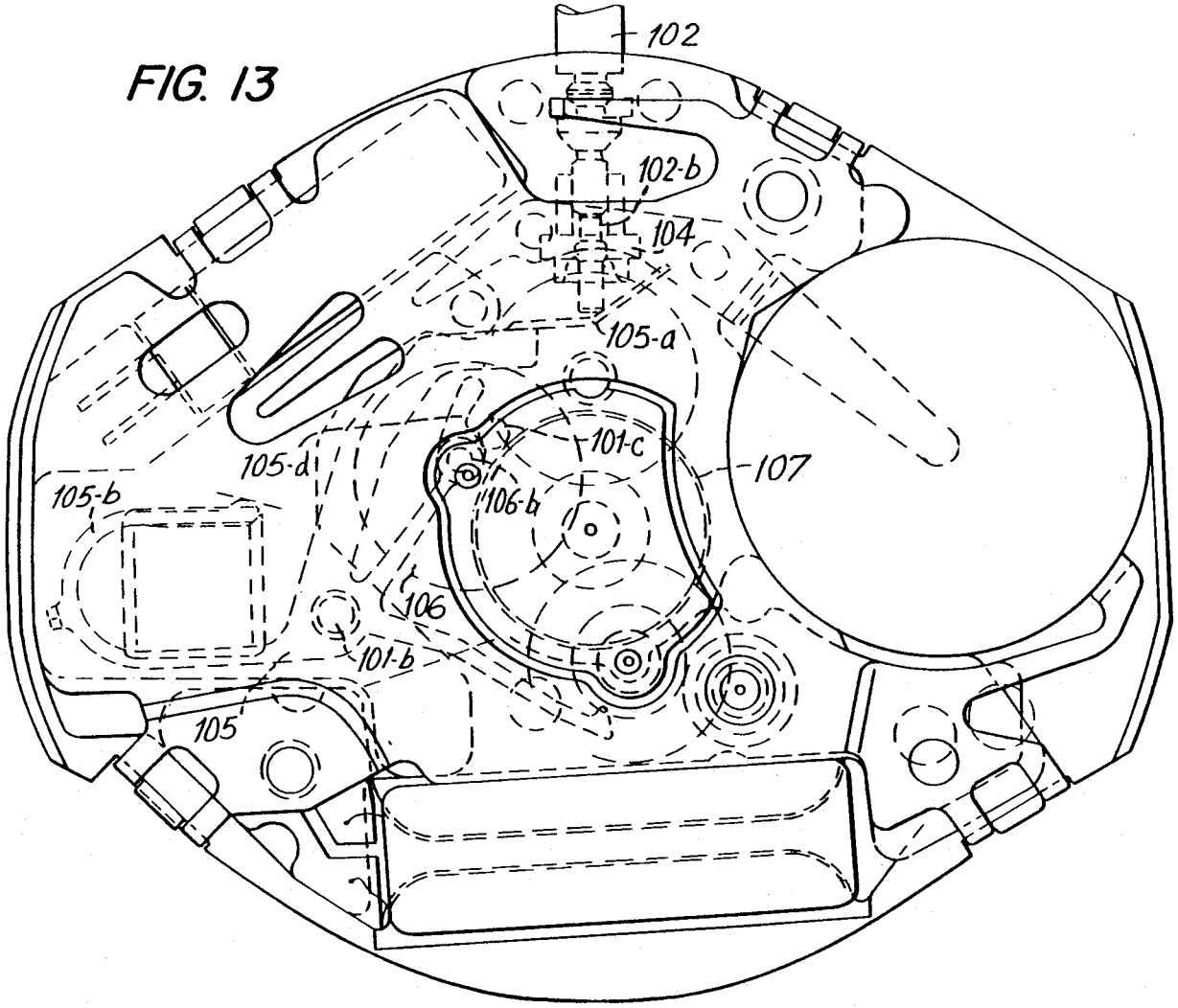

FIGS. 12 and 13 shows the second example of an operating lever other than one of FIG. 1.

FIG. 12 is a plan view of the timepiece according to the present invention in the normal operating condition.

FIG. 13 is a plan view of the timepiece according to the present invention in the time correcting condition.

In the drawings, main plate 1 is a frame for tiempiece. Winding stem 102 is an external operating member. Winding stem 102 has concave portion 102-*a*, convex portion 102-*b* and click portion 102-*a*. The concave portion 102-*a* is loosely engaged with the clutch wheel in the normal operating condition. The convex portion 102-*b* is frictionally engaged with the clutch wheel in the time correcting condition. The clutch wheel is positioned by the battery plus terminal. Clutch wheel 104 is loosely engaged with the winding stem and consists of plastic materials. Operating lever 105 is guided by axis 101-*b* which is provided on the main plate. The operating lever 105 has the portion 105-*a* which contacts with the end portion of winding stem as the above mentioned external operating member, 105-*a* and the elastic portion 105-*b* which rotates around the axis 101-*b* of the main plate and urges the operating lever into the anticrockwise direction, 105-*b*. Holding portion 105-*c* guides and holds the lower pivot of the third wheel and pinion 106. Further, the holding portion has projection for controlling the following fifth wheel and pinion. The third wheel and pinion 106 are made of plastic materials in which wheel and pinion are formed in one body. In the vicinity of the third wheel and pinion guide and the holding portion of the operating lever, the contact portion for contacting with the projection of the main plate is provided to reduce the variation of the accuracy in the engagement distance of the gear train.

Center wheel and pinion 107 are made of plastic materials in which the wheel and pinion are formed of one body. Minute wheel is made of plastic wheel and pinion in which the wheel and the pinion is formed of one body. The wheel is always engaged with the above mentioned center pinion and the wheel of clutch wheel. Namely, the clutch wheel is driven by the minute wheel. In the normal operating condition, the clutch wheel rotates the winding stem. The fourth wheel and pinion 110 are made of plastic materials in which wheel and pinion is formed of one body. The fifth wheel and pinion 114 is made of plastic materials in which the wheel and pinion is formed of one body in the same manner as the gear train. The fifth wheel and pinion is formed of one body with the control cam. Rotor 115 is made of plastic materials formed of a magnet by outserting and has a pinion. The gear train bridge guides the rotar, the fifth wheel and pinion, the fourth wheel and pinion, the third wheel and pinion, the upper pinion of the minute wheel.

All the members of the gear train functions as known in the normal operation condition.

Thereafter, the time correction condition is explained.

By pulling out the winding stem, the end portion of the winding stem is removed from the engaging portion of the operating lever, and the operating lever is rotated anticlockwise around the guide axis 101-*b*. Therefore, the gear train holding portion is moved, the third wheel and pinion are tilted as a result of guiding the gear train bridge pivot, and the third pinion is removed from the engagement of the center wheel and pinion.

The clutch wheel is frictionally engaged with the convex portion of the winding stem 102-*b* and interlocked with the movement of the winding stem. Namely, since the clutch wheel and the winding stem is closely fixed, the clutch wheel is elastically deformed, thereby obtaining the given constant torque.

When the time is corrected in this condition, as generally known, the rotation of the minute wheel is transmitted to the center wheel (and pinion), and the rotation of the pinion is transmitted to the clutch wheel to enable the time correction for hours, minutes and seconds.

Thus by removing the center wheel and pinion from the engagement of the third wheel and pinion, the shear mechanism is not necessary in the gear train, and the rotary torque is loaded when time is corrected. Therefore, according to the present invention, all the gear train members can be formed of plastic though the conventional timepiece uses metallic materials for a gear train and, more specifically, for the gear train members for time correcting mechanism. Accordingly, the manufacturing process can be simplified and the cost of members can reduced.

In the above examples, the operating lever is directly moved by an external controlling member and it may be moved via another member. Further, the engagement is released in between the center wheel and pinion and the third pinion, and it can be released in between the third wheel and pinion and the forth pinion. Furthermore, in the description of the invention, the lower pivot is moved to release the engagement of the gear train, and the upper pivot may be moved simultaneously with the lower pivot to release the engagement of the gear train.

What is claimed is:

1. A timepiece structure comprising:

a main plate;

a transducer composed of a stepping motor;

a gear train bridge;

a gear train including at least one wheel and pinion driven by said transducer supported between the main plate and the gear train bridge;

a displaying gear train driven by said gear train and including an hour hand and a minute hand mounted thereon;

an external controlling member having an axis, the member displaceable to a plurality of axis positions including a time correcting position guided by the main plate; and a time correcting member which is engaged and connected with said external controlling member and said displaying gear train when the external controlling member is displaced to said time correcting position;

an operating lever mounted on said main plate for supporting at least one pivot of said wheel and pinion of said gear train;

said operating lever comprising a supporting portion for said wheel and pinion, a rotary center, and an engaging portion interlocked with said external controlling member;

the wheel and pinion being supported at a first end by the operating lever and at a second opposed end by the gear train bridge; and when said external controlling member is placed in the time correcting position the operating lever displaces the rotary center to incline the axis of the wheel and pinion to disengage the wheel and pinion from the remaining gears of the gear train, whereby the transmission of driving power is interrupted.

2. The timepiece structure of claim 1, wherein said gear train is made of all plastic material.

3. The timepiece structure of claim 1, wherein said engaging portion which interlocks with said external controlling member is formed of elastic members and said supporting portion for said wheel and pinion is formed of rigid members.

4. The timepiece structure of claim 3, wherein said rigid portion of said operating lever includes an end portion which is engaged with a positioning member of the main plate.

5. The timepiece structure of claim 1, wherein the pivot of said wheel and pinion is supported by said operating lever and in said position for time correcting, said pinion is held in a non-engaging position with respect to the gear train.

6. The timepiece structure of claim 5, wherein said wheel engages the gear train members when said pinion is in a non-engaging position with respect to the other gear train.

7. The timepiece structure of claim 1, further comprising a clearance determining member mounted on said main plate, disposed opposite the wheel supported by said operating lever and simultaneously said clearance determining member being formed along a line between the rotary center of said operating lever and the supporting portion of said wheel.

8. The timepiece structure of claim 1, wherein said correcting member includes a correcting wheel which is loosely affixed about the axis of the external operating member in the normal operation condition, said correcting wheel comprising an engaging portion which is engaged with the main plate, thereby positioning said correcting wheel in the axis direction and a bore portion which is closely engaged with the convex portion on the axis of said external controlling member in the time correcting position.

9. The timepiece structure of claim 1, wherein a distance between the portion of the gear train bridge supporting the wheel and pinion and a portion of the gear train which engages the wheel and pinion is greater than or equal to a distance between the portion of the gear train bridge which supports the wheel and pinion and the wheel of the wheel and pinion.

* * * * *